US010408433B2

(12) United States Patent
Casper et al.

(10) Patent No.: US 10,408,433 B2
(45) Date of Patent: Sep. 10, 2019

(54) LED MODULE

(71) Applicant: SIGNIFY HOLDING B.V., Eindhoven (NL)

(72) Inventors: Lars Christian Casper, Eindhoven (NL); Marijn Geels, Eindhoven (NL); Johannes Maria Thijssen, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 15/548,037

(22) PCT Filed: Jan. 19, 2016

(86) PCT No.: PCT/EP2016/050945
§ 371 (c)(1),
(2) Date: Aug. 1, 2017

(87) PCT Pub. No.: WO2016/124385
PCT Pub. Date: Aug. 11, 2016

(65) Prior Publication Data

US 2018/0017235 A1 Jan. 18, 2018

(30) Foreign Application Priority Data

Feb. 5, 2015 (EP) ..... 15153977

(51) Int. Cl.

| | |
|---|---|
| ***F21V 3/00*** | (2015.01) |
| ***F21V 5/00*** | (2018.01) |
| ***F21V 17/00*** | (2006.01) |
| ***F21V 31/00*** | (2006.01) |
| ***F21K 9/90*** | (2016.01) |

(Continued)

(52) U.S. Cl.
CPC ..... *F21V 17/005* (2013.01); *F21K 9/90* (2013.01); *F21V 5/007* (2013.01); *F21V 17/06* (2013.01); *F21V 17/101* (2013.01); *F21V 31/005* (2013.01); *F21V 9/30* (2018.02); *F21V 17/10* (2013.01); *F21Y 2105/10* (2016.08); *F21Y 2115/10* (2016.08)

(58) Field of Classification Search
CPC ..... F21K 9/00; F21K 9/60–69; F21K 9/90; F21V 5/007; F21V 17/005; F21V 17/04; F21V 17/06; F21V 17/10; F21V 17/101; F21V 17/104; F21V 31/005; F21Y 2105/10–18
USPC ..... 362/249.02, 311.02
See application file for complete search history.

(56) References Cited

U.S. PATENT DOCUMENTS 8,101,434 B2 1/2012 Guillien et al.
9,439,299 B2 * 9/2016 Tudhope ..... F21V 23/005
(Continued)

FOREIGN PATENT DOCUMENTS

CN 101331356 A 12/2008
CN 202382169 U 8/2012
(Continued)

*Primary Examiner* — Jason M Han

(57) ABSTRACT

Presented is an LED module comprising: a printed circuit board, PCB, with a plurality of LEDs mounted thereon; and first and second optical cover plates each comprising an optically transmissive portion and coupled to the PCB so as to cover a respective subset of the plurality of LEDs. The first and second optical cover plates have complementary geometries so that they are self-aligning in two axes.

10 Claims, 5 Drawing Sheets

(51) Int. Cl.

| | |
|---|---|
| ***F21V 17/06*** | (2006.01) |
| ***F21V 17/10*** | (2006.01) |
| *F21V 9/30* | (2018.01) |
| *F21Y 105/10* | (2016.01) |
| *F21Y 115/10* | (2016.01) |

(56) References Cited

U.S. PATENT DOCUMENTS

| | | | | |
|---|---|---|---|---|
| 2005/0083691 | A1 | 4/2005 | Jahn et al. | |
| 2011/0103051 | A1 | 5/2011 | Wilcox et al. | |
| 2012/0320585 | A1 | 12/2012 | Lin et al. | |
| 2013/0301264 | A1* | 11/2013 | Van Gompel ..... | F21S 2/005 362/236 |

FOREIGN PATENT DOCUMENTS

| | | | |
|---|---|---|---|
| CN | 202915197 | U | 5/2013 |
| CN | 103527951 | A | 1/2014 |
| DE | 102013104240 | A1 | 10/2014 |
| KR | 101284261 | B1 | 7/2013 |
| WO | 2012029002 | A1 | 3/2012 |
| WO | 2012101547 | A1 | 8/2012 |

* cited by examiner

LED MODULE

CROSS-REFERENCE TO PRIOR APPLICATIONS

This application is the U.S. National Phase application under 35 U.S.C. § 371 of International Application No. PCT/EP2016/050945, filed on Jan. 19, 2016 which claims the benefit of European Patent Application No. 15153977.2, filed on Feb. 5, 2015. These applications are hereby incorporated by reference herein.

FIELD OF THE INVENTION

This invention relates to the field of lighting modules employing light emitting diodes (LEDs), and more particularly to LED modules comprising LEDs provided on a PCB.

BACKGROUND OF THE INVENTION

Exposed lens plate luminaires typically comprise LED modules mounted in a housing or supporting mechanism with no additional shielding or protection provided to the light emitting surface of the LED module. As such, an exposed lens plate luminaire may have fewer parts than other lighting arrangements, resulting in a lower cost luminaire with increased light output and an improved beam profile.

Known LED modules employed in exposed lens plate luminaires comprise an LED light source; and an optically transmissive cover element (hereinafter referred to as an optical cover plate). The LED light source typically comprises a printed circuit board (PCB) with a plurality of LEDs mounted thereon, said LEDs being adapted to output light from a light-emitting surface of the printed circuit board. Optionally, such LED modules are known to further comprise additional thermal management elements, e.g. a heat sink.

Employing an optical cover plate to cover the LEDs mounted on the PCB typically introduces optical losses in the region of 5-10%. Due to size and weight constraints for a luminaire, such losses cannot be compensated by installing more LEDs or driving them at a higher current.

Further, employing a single optical cover plate to cover a relatively large PCB is not feasible because large optical plates cannot be produced via injection molding. Also, large optical cover plates can introduce alignment problems between optical elements of the optical cover plate and the LEDs, due to tolerances, differences in thermal expansion, and/or stresses due to differences in thermal expansion.

SUMMARY OF THE INVENTION

The invention is defined by the claims.

According to a first aspect of the invention, there is provided an LED module, comprising: a printed circuit board, PCB, with a plurality of LEDs mounted thereon; and first and second optical cover plates each comprising an optically transmissive portion and coupled to the PCB so as to cover a respective subset of the plurality of LEDs, wherein the first and second optical cover plates have complementary geometries so that they are self-aligning in two axes, each of the first and second optical cover plates further comprises a respective sealing groove surrounding the respective subset of the plurality of LEDs and wherein the complementary geometries bridge the respective sealing grooves of the first and second optical cover plate to form one integral sealing groove.

Proposed is a concept for covering a plurality of LEDS (provided on a PCB) with multiple optical cover plates. Embodiments may enable large PCBs to be covered with optical cover plates where it is not practical or viable to cover the PCB with only a single optical cover plate. Correct or proper alignment of the optical cover plates may be ensured through the proposed concept of adapting the optical cover plates to have complementary shapes so that they may be self-aligning with each other in two orthogonal axes (e.g. in the X-axis and Y-axis). In other words, embodiments may comprise optical cover plates which when properly arranged in inter-fitting relation are adapted to cover LEDs provided on a PCB. The PCB generally comprises in the order of several tens to several thousands of LEDs mounted on thereon. Depending on the amount of LEDs and their mutual spacing, the covering of the LEDs is attained by a number of optical cover plates, said number of cover plates ranging from two to about hundred. In other words, the number of LEDs comprised in a subset covered by a single cover plate is at least twelve, preferably at least 24, for example 40, but can amount up to about 300 LEDs.

Thus, there is proposed a concept that sits between the undesirable extremes of: (i) covering each individual LED with its own respective optical cover plate; and (ii) covering all LEDs on a large PCB with a single optical cover plate involving the problems as mentioned at the background of the invention. By arranging a plurality of optical cover plates to have complementary geometries (such as matching edge shapes that are adapted to inter-fit with each other for example), the optical cover plates can be tiled such that edges of the optical cover plates can be interlocked and/or aligned easily.

In general, the interlocking geometries comprise a projection formed to extend from the side of the first optical cover plate (at one end) and adapted to engage with a sealing groove or channel with an aperture formed in the side of the sealing groove of the second optical cover plate. Such projections may otherwise be understood to be a protrusion, flange or an outthrust that extends at an angle from an edge of the optical cover plate. Each projection may therefore be considered to be a male connection part that is adapted to engage with a female connection part of the adjacent optical cover plate. In particular, the sealing groove has a U-shaped cross section transverse to the length direction of the groove. The U-shape can be seen as two standing walls of a U mutually connected via a base of said U. Each pair of mutually interlocking geometry comprises a protrusion and an indentation. Each protrusion is a bridging channel that bridges the sealing grooves of two adjacent, mutually connected optical cover plates, and forms a continuous walled channel therewith. Thereto, the indentation is a concave cut into one wall of the U-shaped sealing groove. The base of the sealing groove is about flush with the base of the bridging channel. Hence, when two optical cover plates are connected via their interlocking geometries the respective sealing channel of each cover plate are mutually connected via the bridging channel and forms one integral sealing groove for the mutually connected optical cover plates. Instead of having sealant and interlocking geometries next to each other, requiring relatively much space, these function are now integrated into one part, i.e. the bridging channel, requiring relatively little space. Thus it is enabled to maintain the sealing of each optical plate and with a relatively dense packing of the LEDs, yet without the thermal expansion problems of a single optical plate or the problems of laborious manufacturing associated with covering each individual LED with its own respective optical plate.

Multiple optical cover plates may therefore be strategically arranged in the horizontal axes, for example, so that they align with the plurality of LEDs provided on the PCB. For example, a plurality of optical cover plates may be tiled with each other and arranged such that, when viewed from directly above (i.e. in plan view), the optical cover plates are tessellated. By arranging the optical cover plates to tessellate, space savings (e.g. a reduction in foot print size) may be achieved.

Furthermore, the optical cover plates may be arranged such that there is substantially zero separation between adjacent edges of the optical cover plates. In practice, however, it may be difficult to perfectly align adjacent edges to have zero lateral separation or overlap. Thus, in embodiments, the optical cover plates may slightly overlap or may be laterally separated by a negligible or small amount at some positions. For example, there may be a lateral separation or overlap between the adjacent edges of the first and second optical cover plates, and this lateral separation or overlap may be less than 10% of the lateral width of a single optical cover plate. In embodiments, it may be preferable to reduce such separation or overlap to a minimum value (e.g. less than 5% of the lateral width of a single optical cover plate, and even more preferably less than 1% of the lateral width of a single optical cover plate).

The LED light sources of the present disclosure may be any type of LED, such as a Flip Chip type (Thin Film Flip Chip), Patterned Sapphire Substrate, top connected/top emission, top-bottom connected. Also, the light source could be used as naked die, or packaged.

In an embodiment, each of the sealing grooves surrounding the respective subset of the plurality of LEDs is provided with a sealant adapted to sealably connect the optical cover plate to the PCB. Sealant provided in the sealing groove may help prevent penetration of external or foreign contaminants through the sealing groove. Thus, some embodiment may be adapted to prevent ingress of contaminants through the sealing groove Examples of foreign contaminants may comprise: particles of dust; moisture; or air. Embodiments may therefore be self-sealing to prevent the ingress of foreign contaminants such as dust or water, in accordance with IP66 and IP67. The sealant preferably covers and protects the side faces of the PCB' to counteract delamination of the PCB due to ingress of water, for example due to humid air.

Thus, each optical cover plate may be sealably connected to the PCB so as to prevent the ingress of dust, water or other contaminants into the covered volume it defines with the PCB.

In some embodiments, the sealant may be adhesive so as to help adhere the optical cover plate to the PCB.

Some embodiments may employ a mechanically fixing for connecting the optical cover plate to the PCB. For example, there may be provided a plug for mechanical fixation of the optical cover plate to the PCB and for mounting the LED module into an external support.

Further, for mounting an embodiment, there may be provided an external support or housing that may also act as a heat sink. An exemplary plug for mechanical fixation of the LED module may comprise a clamp that fixes into the PCB for securing the LED module to the plug. In such embodiments, clamping may only be performed in a single direction only (e.g. along the length of the PCB) such that dimensional variations of the LED module (such as those caused by temperature changes) may be accounted for. By protecting against variations in this manner, the risk of accidental stresses, which may cause damage to the LED module, may be somewhat mitigated.

The first and second optical cover plates may comprise interlocking geometries adapted to maintain the first and second optical cover plates in a predetermined arrangement relative to each other. An interlocking geometry may comprise a projection formed to extend from the first optical cover plate and adapted to engage with channel or aperture formed in the second optical cover plate. Such a projection may otherwise be understood to be a protrusion, flange or an outthrust that extends at an angle from an edge of the optical cover plate. The projection may therefore be considered to be a male connection part that is adapted to engage with a female connection part of another optical cover plate.

In a further embodiment, a lateral separation between adjacent edges, not taking projections into account, of the cover plates may be intentionally provided. This lateral separation may, for example, be no more than 5%, preferably no more than 1%, of the lateral width of a single optical cover plate. Such a lateral separation may permit small displacements or changes in width of the optical plates due to, for example, thermal expansions.

In an embodiment, the optically transmissive portion of at least one of the first and second optical cover plates may comprise an optical enhancement material. Optical enhancement material may be a 'color conversion fill', such as a luminous ceramic material or phosphorescent material. This may further help to maintain the etendue of the lateral emission area.

Further, if an embodiment comprises a plurality of cavities formed in an optical cover plate, the cavities may comprise (e.g. be filled with) different materials. As an example, certain cavities may be filled with a first type of phosphor (e.g. converting blue to white) and other cavities may be filled with another type of phosphor (e.g. converting blue to red).

Embodiments may be employed in the field of automotive lighting and other fields/applications where the use of LEDs may be desirable. Thus, according to an aspect of the invention, there may be provided an automotive light comprising an LED module according to an embodiment.

An embodiment may provide an optical cover plate adapted to be coupled to a PCB having a plurality of LEDS mounted thereon so as to form a LED module, the optical cover plate comprising: an optically transmissive portion; and wherein at least one edge of the optical cover plate is shaped to have complementary geometry with an adjacently positioned further optical cover plate so that it is self-aligning in two axes. Thus, embodiments may provide an optical cover plate that can be supplied separately from the LED module.

The optical cover plate may further comprise a sealing groove adapted to surround the plurality of LEDs and to receive an adhesive for sealably connecting the optical cover plate to the PCB so as to prevent ingress of contaminants through the sealing groove.

According to a second aspect of the invention there is provided a method of covering a printed circuit board, PCB, having a plurality of LEDs mounted thereon, the method comprising: coupling a first and second optical cover plate to the PCB so as to cover a respective subset of the plurality of LEDs, wherein each cover plate comprises an optically transmissive portion and the first and second cover plate have a complementary geometry so they are self-aligning in two axes: providing each of the first and second optical covers plates with a respective sealing groove arranged to surround the respective covered subset of the covered LEDs; and forming the respective sealing grooves of the adjacent first and second optical cover by the complementary geometries into one, integral sealing groove.

The method may further comprise: providing adhesive sealant between the cover plate and the PCB, adapted to sealably adhere the optical cover plate to the PCB.

Optionally, the method may be adapted wherein the first and second optical cover plates comprise interlocking geometries adapted to maintain the first and second optical cover plates in a predetermined arrangement relative to each other.

In a further embodiment of this method, the interlocking geometry may comprise a projection formed to extend from the first optical cover plate and adapted to engage with a channel or aperture formed in the second optical cover plate.

There may be a method wherein the optically transmissive portion of at least one of the first and second optical cover plates comprises an optical enhancement material.

An embodiment may provide a method for manufacturing an LED module, comprising: providing a printed circuit board, PCB, with a plurality of LEDs mounted thereon; and coupling first and second optical cover plates each comprising an optically transmissive portion to the PCB so as to cover a respective subset of the plurality of LEDs, wherein the first and second optical cover plates have a complementary geometry so that they are self-aligning in two axes.

These and other aspects of the invention will be apparent from and elucidated with reference to the embodiment(s) described hereinafter.

BRIEF DESCRIPTION OF THE DRAWINGS

Examples in accordance with aspects of the invention will now be described in detail with reference to the accompanying drawings, in which.

DETAILED DESCRIPTION OF THE EMBODIMENTS

Proposed is a concept for covering a plurality of LEDS provided on a single PCB. Embodiments may enable large PCBs to be covered with multiple optical cover plates where it is not practical or viable to cover the PCB with only a single optical cover plate, for example. Such optical cover plates may cover the LEDs to provide protection from wind, rain, dust, foreign particles, etc. Further, the optical cover plates may be sealably connected to the PCB so as to provide a seal which restricts or prevents the ingress of contaminants to a covered area of the PCB.

Alignment of the optical cover plates may be assisted by the optical cover plates having complementary shapes so that they fit together in a way which ensures their alignment with each other in two orthogonal axes (e.g. in the horizontal plane). In other words, the optical cover plates may be shaped to have matching side shapes which are arranged to have an inter-fitting relation. The optical cover plates may therefore be tiled such that edges of the optical cover plates can be interlocked and/or aligned easily.

When fitted together, the positional relationship between the optical cover plates can ensure that a predetermined alignment is obtained, thus helping to ensure that the optical cover plates can be aligned with the PCB and/or the LEDs. Multiple optical cover plates may therefore be strategically arranged in the horizontal axes, for example, so that they align with the plurality of LEDs provided on the PCB.

Figure 1:
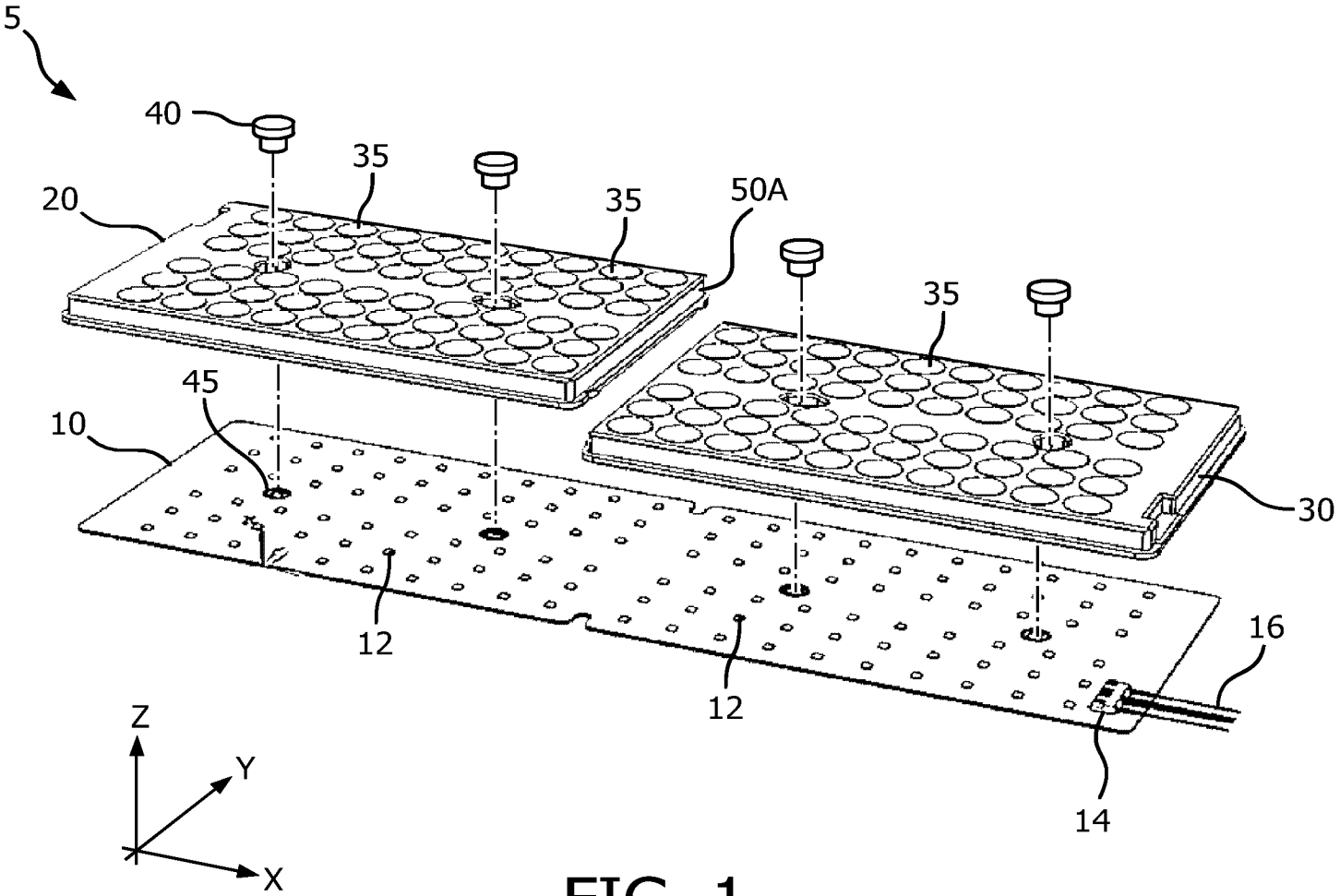
FIG. 1 depicts a schematic overview of components for an LED module according to an embodiment.

Referring now to FIG. 1, there is depicted a schematic overview of components for an LED module 5 according to an embodiment.

A single (relatively) large PCB 10 is provided with a plurality of LEDs 12 mounted thereon. The PCB 10 is also provided with a connection unit 14 to which a plurality of wires 16 is connected for providing electric power and possibly signals to the PCB 10.

First 20 and second 30 optical cover plates are provided for mounting on the upper surface of the PCB 10 so as to cover the LEDs 12. Each of the first 20 and second 30 optical cover plates comprises an array of optically transmissive portions 35, wherein each optically transmissive portion 35 is arranged to align with a respective LED 12. In this embodiment, each optically transmissive portion 35 may comprise an optical enhancement material, such as a luminous ceramic material or phosphorescent material. The light output from each LED is therefore arranged to be converted by its respectively arranged optically transmissive portion 35. In this way, the first 20 and second 30 optical cover plates may be adapted to output light of differing or various colors.

For mechanically fixing the optical cover plates 20 and 30 to the PCB 10, fixation plugs 40 are provided. The fixation plugs 40 are adapted to be inserted into respective apertures 45 formed in the PCB 10. When inserted into the apertures 45, the fixation plugs 40 span through both the PCB 10 and an associated optical cover plate 20 or 30. Here, the fixation plugs 40 are adapted such that they do not extending beyond the bottom surface of the PCB 10. A mechanical fastener (not shown), such as a screw for example, is mountable within the plug for affixing the plug to an external support (such as a heat sink, for example).

The first 20 and second 30 optical cover plates have complementary geometries so that they are self-aligning in the horizontal plane. In this way, the first 20 and second 30 optical cover plates may be placed next to each other (in the horizontal plane) so that their adjacent side edges complement each other and restrict movement in both the X-axis and the Y-axis.

More specifically, in this embodiment, the first 20 and second 30 optical cover plates comprise interlocking geometries for maintaining the first 20 and second 30 optical cover plates in a predetermined arrangement relative to each other.

Figure 2:
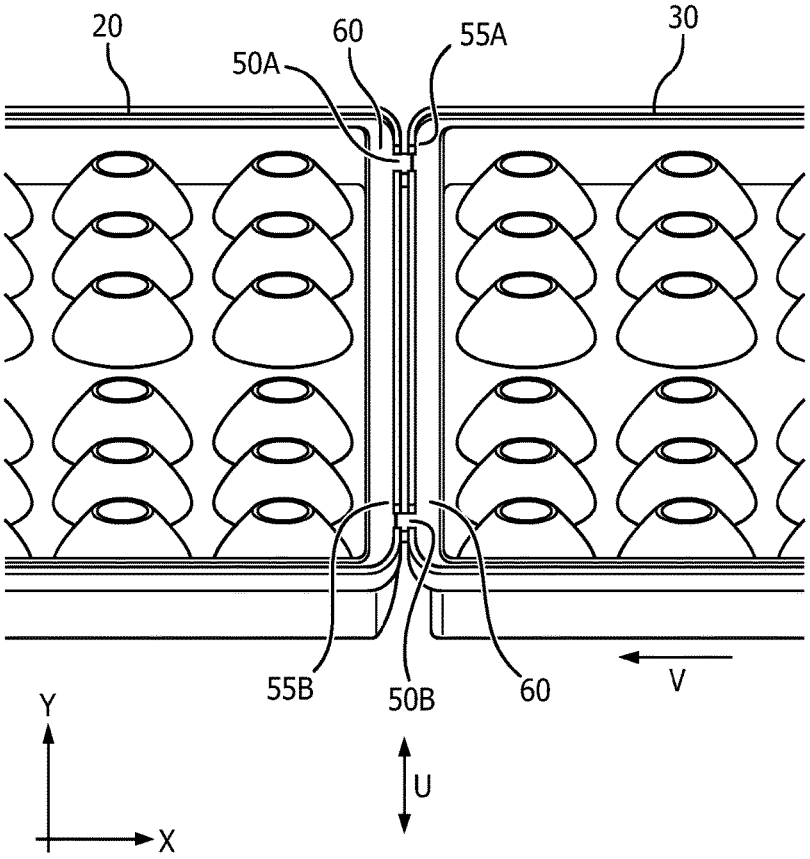
FIG. 2 shows the interlocking geometries of the embodiment of FIG. 1.

FIG. 2 shows these interlocking geometries in more detail.

Here, the interlocking geometries comprise a projection 50A formed to extend from the side of the first optical cover plate 20 (at one end) and adapted to engage with a sealing groove, channel or aperture 55A formed in the side of the second optical cover plate 30. Further, at the other end of the side, a projection 50B is formed to extend from the side of the second optical cover plate 30 and adapted to engage with a sealing groove, channel or aperture 55B formed in the first optical cover plate 20. Such projections may otherwise be understood to be a protrusion, flange or an outthrust 50 that extends at an angle from an edge of the optical cover plate. Each projection may therefore be considered to be a male connection part that is adapted to engage with a female connection part of the adjacent optical cover plate. Also with reference to FIG. 3, in particular, the sealing groove has a U-shaped cross section transverse to the length direction of the groove. The U-shape can be seen as two standing walls 60X of a U mutually connected via a base 60Y of said U. Each pair of mutually interlocking geometry comprises a protrusion and an indentation. Each protrusion is a bridging channel that bridges the sealing grooves of two adjacent, mutually connected optical cover plates, and forms a continuous walled channel therewith. Thereto, the indentation is a concave cut into one wall of the U-shaped sealing groove. The base of the sealing groove is about flush with the base 60Z of the bridging channel. Hence, when two optical cover plates are connected via their interlocking geometries the respective sealing channel of each cover plate are mutually connected via the bridging channel and forms one integral sealing groove for the mutually connected optical cover plates.

Interconnection of male and female parts of the interlocking geometries aligns the first 20 and second 30 optical cover plates in the horizontal plane. In particular, cooperation of each projection with its respective channel/aperture restricts movement of one optical cover plate relative to the other in the direction of the Y-axis. For example, referring to FIG. 2, movement of the second optical cover plate 30 (relative to the first optical plate 20) in the up or down direction (as indicated by the arrow labeled "U") is restricted. Also, cooperation of each projection with its respective channel/aperture restricts movement of one optical cover plate relative to the other in the direction of the X-axis. For example, referring to FIG. 2, movement of the second optical cover plate 30 (relative to the first optical plate 20) in the left direction (as indicated by the arrow labeled "V") is restricted.

It will therefore be understood that interconnection of male and female parts of the interlocking geometries aligns the first 20 and second 30 optical cover plates in both the X- and Y-axes. Further, in this way, the optical cover plates can be arranged such that there is zero separation between the adjacent edges of the optical cover plates 20 and 30.

Figure 3:
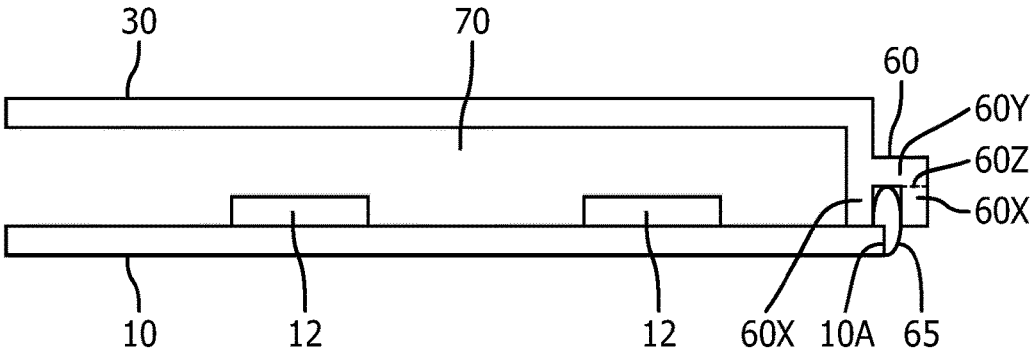
FIG. 3 shows a cross sectional view of part of the embodiment of FIG. 1, wherein the optical cover plates have been positioned to contact the upper surface of the PCB.

Turning to FIG. 3, there is depicted a cross sectional view of part of the embodiment of FIG. 1, wherein the optical cover plates 20 and 30 have been positioned to contact the upper surface of the PCB 10. Here, only the second optical cover plate 30 is shown.

The second optical cover plate 30 comprises a sealing groove 60 around its peripheral edge. In this way, the sealing groove surrounds the plurality of LEDs 12 covered by the second optical cover plate 30.

Adhesive sealant 65 is provided in the sealing groove 60 to sealably connect the second optical cover plate 30 to the PCB 10. The sealant 65 also helps to create a seal between the second optical cover plate 30 and the PCB 10 for preventing ingress of contaminants (such as water and dust, for example) into the volume 70 (defined between upper surface of the PCB 10 and the downwardly facing surface of the second optical cover plate 30. The sealant also covers and protects the side face 10A of the PCB 10 against ingress of water.

Thus, the second optical cover plate 30 is adapted to be sealably connected to the PCB 10 so as to prevent the ingress of dust, water or other contaminants into the covered volume it defines with the PCB 10. Preferably, the sealant may be adhesive so as to help stick the optical cover plate 30 to the PCB 10.

Figure 4:
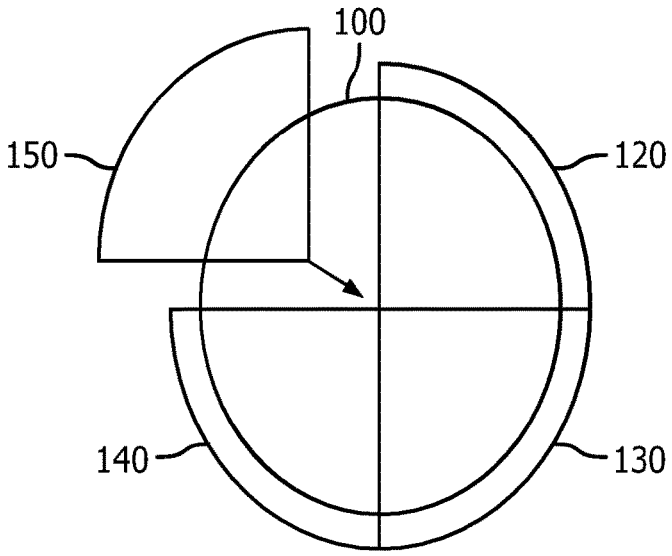
FIG. 4 shows a plan view of components for an LED module according to an embodiment.
Figure 5:
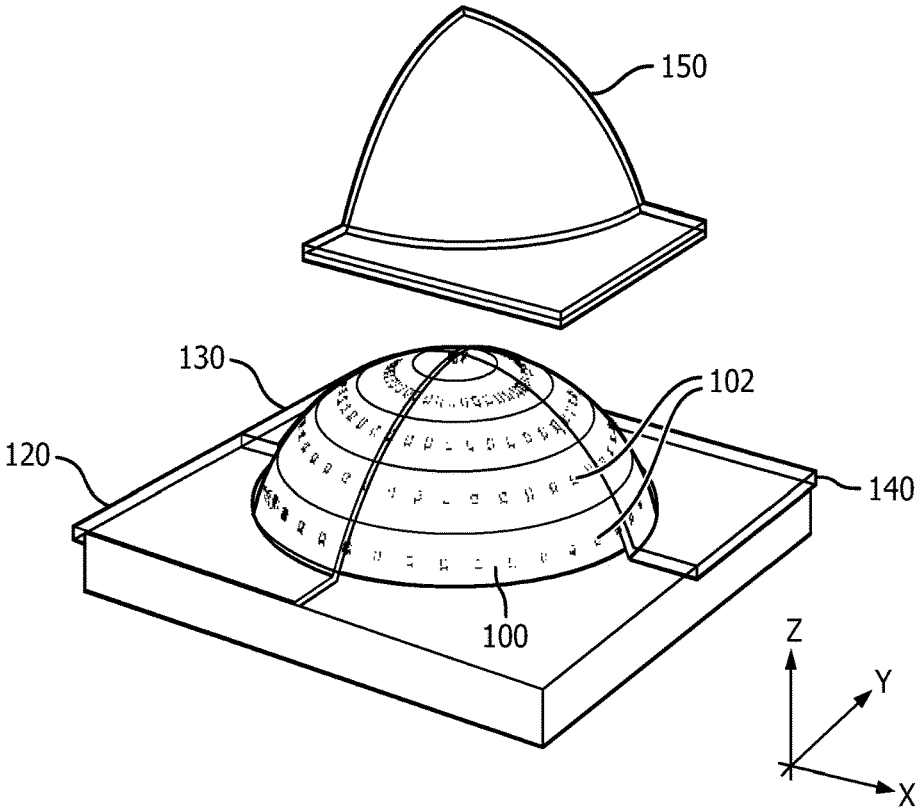
FIG. 5 is an isometric view of the embodiment of FIG. 4.

Referring now to FIGS. 4 and 5, there is depicted another embodiment. FIG. 4 shows a plan view of components for an LED module according to an embodiment. FIG. 5 is an isometric view of the embodiment of FIG. 4.

A single dome-shaped PCB 100 is provided with a plurality of LEDs 102 mounted thereon. More specifically, the PCB 100 is hemispherical in shape (i.e. half a sphere) and thus comprises a 3-dimensional curved surface that extends not only in the X- and Y-axes but also in the Z-axis.

A first 120; a second 130; a third 140; and a fourth 150 optical cover plates are provided for mounting on the upper surface of the PCB 100 so as to cover the LEDs 102. Each of the first 120 to fourth 150 optical cover plates is formed from an optically transmissive material and is adapted to cover one quarter (¼) of the surface of the PCB 100 (and the LEDs 102 provided thereon). Each optical cover plate therefore comprises one single large light transmissive portion that is adapted to transmit light from the plurality of LEDs it covers.

The first 120 to fourth 150 optical cover plates have complementary geometries so that they are self-aligning with each other. In this way, the first 120 to fourth 150 optical cover plates may be tessellated so that adjacent side edges of the optical cover plates complement each other and restrict movement in both the X-axis and the Y-axis.

In this embodiment, the first 120 to fourth 150 optical cover plates comprise interlocking geometries for maintaining the first 120 to fourth 150 optical cover plates in a predetermined arrangement relative to each other. More specifically, the interlocking geometry comprises a tongue and groove arrangement, wherein an edge of one optical cover plate is provided with a tongue that is adapted to cooperate (e.g. fit) with a groove provided in the side of adjacent optical cover plate.

Figure 6:
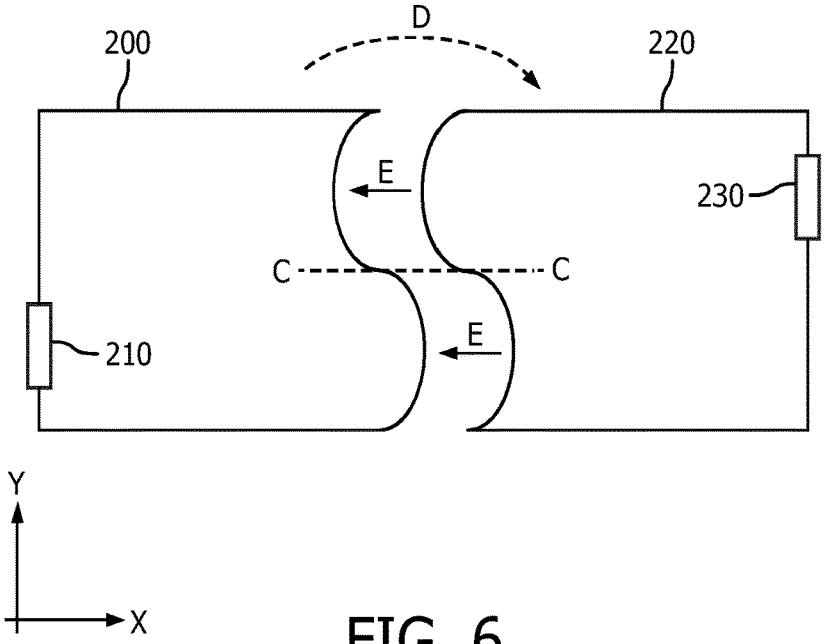
FIG. 6 is a simplified diagram of a first and second optical cover plates according to an embodiment.

Referring to FIG. 6, there is depicted a first 200 and second 220 optical cover plates according to an embodiment.

Here, the first 200 and second 220 optical cover plates are identical. The first 200 and second 220 optical cover plates each comprises a respective connection unit 210, 230 through which cables/wires are adapted to be passed for connection to a PCB (not shown). The side of the optical cover plate that is opposite the connection unit 210, 230 is shaped so as to extend in both the X- and Y-axes and also to be asymmetrical about the central longitudinal axis "C-C" of the optical cover plate (extending in the X-axis). In this example, these edges are S-shaped and therefore have complementary shapes so that they can be fitted together, as depicted by the arrows labeled "E".

Thus, the first 200 and second 220 optical cover plates are adapted and arranged such that the second optical cover plate 220 is the same as the first optical cover plate 200 when rotated by 180 degrees (as depicted by the arrow labeled "D").

The first 200 and second 220 optical cover plates are self-aligning in that, when fitted together, lateral displacement of one optical cover plate relative to the other is restricted in the Y-axis. Also, lateral displacement of one optical cover plate relative to the other is restricted in the X-axis in that the optical cover plates can only be moved towards each other in the X-axis until their S-shaped edges contact each other.

It will therefore be appreciated that when the first 200 and second 220 optical cover plates are fitted together, as depicted by the arrows labeled "E", the optical cover plates are inherently aligned to a predetermined alignment in the X- and Y-axes. Here, with the S-shaped edges being asymmetrical about the central longitudinal axis "C-C" of the optical cover plate, the first 200 and second 220 optical cover plates are aligned with each other in the Y-axis when fitted together. Also, when fitted tighter, the S-shaped edges contact each other such that they share substantially the same position in the X-axis.

Figure 7:
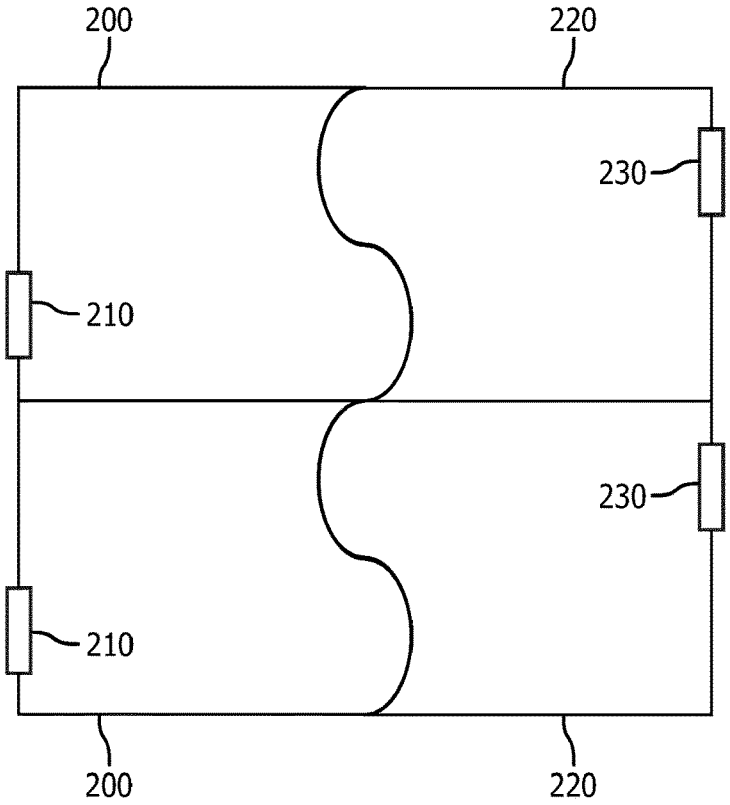
FIG. 7 is a plan view of two pairs of the first and second optical cover plates of FIG. 6 tiled with each other.

Turning now to FIG. 7, it will be appreciated that the first 200 and second 220 optical cover plates of FIG. 6 can be tessellated with further identically arranged optical cover plates. In the example depicted in FIG. 7, two pairs of the first 200 and second 220 optical cover plates of FIG. 6 are tiled with each other and arranged such that, when viewed from directly above (i.e. in plan view as depicted in FIG. 7), the optical cover plates are tessellated.

Accordingly, as demonstrated in FIG. 7, a relatively large approximately square-shaped PCB (with LEDs provided thereon), can be covered with four optical cover plates that are adapted to have complementary shapes so that they are self-aligning when fitted together.

Various modifications will be apparent to the skilled reader.

For example, an optical cover plate may be formed from an optically transmissive material so that the entire optical cover plate is optically transmissive. Further, if an embodiment comprises a plurality of cavities formed in an optical cover plate, the cavities may comprise (e.g. be filled with) different materials. As an example, certain cavities may be filled with a first type of phosphor (e.g. converting blue to white) and other cavities may be filled with another type of phosphor (e.g. converting blue to red).

The LED light sources of the present disclosure may be any type of LED, such as a Flip Chip type (Thin Film Flip Chip), Patterned Sapphire Substrate, top connected/top emission, top-bottom connected. Also, the light source could be used as naked die, or packaged.

Figure 8:
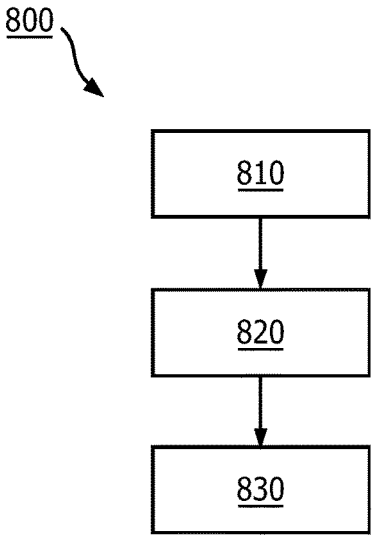
FIG. 8 is a flow diagram of a method of covering a PCB according to an embodiment.

Referring to FIG. 8, there is depicted a flow diagram of a method 800 of covering a PCB having a plurality of LEDs mounted thereon.

The method begins in step 810 when first and second optical covers plates are provided. Each optical cover plates comprises an optically transmissive portion and a sealing groove. The first and second cover plates have complementary shapes so they are self-aligning in orthogonal axes when fitted together.

Next, in step 820, adhesive sealant is provided in the sealing groove of each optical plate.

Finally, in step 830, the optical cover plates are fitted together with their shapes complementing each other and then coupled to the PCB so that each optical cover plate covers a respective subset of the LEDs mounted on the PCB. Here, the optical cover plates are coupled to the PCB using the adhesive sealant provide in the grooves. The optical cover plates are brought into contact with the PCB such that the adhesive sealant forms a seal between the optical cover plates and the PCB. The seal also prevent ingress of contaminants through the sealing grooves.

The invention claimed is:

1. An LED module, comprising:

a printed circuit board, PCB, with a plurality of LEDs mounted thereon; and first and second optical cover plates each comprising an optically transmissive portion and coupled to the PCB so as to cover a respective subset of the plurality of LEDs, wherein the first and second optical cover plates have complementary geometries so that they are self-aligning in two axes, each of the first and second optical cover plates further comprises a respective sealing groove surrounding the respective subset of the plurality of LEDs;

wherein each of the respective sealing grooves has a U-shaped cross section, the U-shaped cross section being formed in the respective cover plate by a base that extends from an edge of the cover plate and is essentially parallel to the cover plate, and two standing walls each connected to the base;

and wherein the complementary geometries bridge the respective sealing grooves of the first and second optical cover plates to form one integral sealing groove.

2. The LED module of claim 1, wherein adhesive sealant is provided in each of the sealing grooves to sealably adhere the optical cover plate to the PCB.

3. The LED module of claim 1, wherein the first and second optical cover plates comprise interlocking geometries adapted to maintain the first and second optical cover plates in a predetermined arrangement relative to each other.

4. The LED module of claim 3, wherein the interlocking geometry comprises a projection formed to extend from the first optical cover plate and adapted to engage with a channel or aperture formed in the second optical cover plate.

5. The LED module of claim 1, wherein the optically transmissive portion of at least one of the first and second optical cover plates comprises an optical enhancement material.

6. A method of covering a printed circuit board, PCB, having a plurality of LEDs mounted thereon, the method comprising:

coupling each of a first and second optical cover plate to the PCB so as to cover a respective subset of the plurality of LEDs, wherein each cover plate comprises an optically transmissive portion and the first and second cover plate have complementary geometries so they are self-aligning in two axes;

providing each of the first and second optical covers plates with a respective sealing groove arranged to surround the respective covered subset of the covered LEDs;

wherein each of the respective sealing grooves has a U-shaped cross section, the U-shaped cross section being formed in the respective cover plate by a base that extends from an edge of the cover plate and is essentially parallel to the cover plate, and two standing walls each connected to the base; and, forming the respective sealing grooves of the adjacent first and second optical cover plates by the complementary geometries into one, integral sealing groove.

7. The method of claim 6, further comprising: providing adhesive sealant in each of the sealing groves, the adhesive sealant being adapted to sealably adhere the optical cover plate to the PCB.

8. The method of claim 6, wherein the first and second optical cover plates comprise interlocking geometries adapted to maintain the first and second optical cover plates in a predetermined arrangement relative to each other.

9. The method of claim 8, wherein the interlocking geometry comprises a projection formed to extend from the first optical cover plate and adapted to engage with a channel or aperture formed in the second optical cover plate.

10. The method of claim 6, wherein the optically transmissive portion of at least one of the first and second optical cover plates comprises an optical enhancement material.

* * * * *